United States Patent [19]

Mixer

[11] 4,246,710

[45] Jan. 27, 1981

[54] BREAKAWAY TAG LABEL HOLDER

[75] Inventor: Terence W. Mixer, Fountain Valley, Calif.

[73] Assignee: Sam Pievac Company, Long Beach, Calif.

[21] Appl. No.: 8,493

[22] Filed: Feb. 2, 1979

[51] Int. Cl.[3] ..... G09F 3/18

[52] U.S. Cl. ..... 40/16.4; 40/124; 211/57.1; 248/DIG. 9

[58] Field of Search ..... 40/10 R, 16 R, 16.2, 40/16.4, 124.1, 124.2, 152, 152.1, 156, 158, 124; 248/DIG. 9; 211/54.1, 57.1, 59.1

[56] References Cited

U.S. PATENT DOCUMENTS

| | | | |
|---|---|---|---|
| 1,523,164 | 1/1925 | Barnard et al. | 248/DIG. 9 |
| 2,916,159 | 12/1959 | O'Neill | 248/DIG. 9 |
| 3,469,813 | 9/1969 | Rizzi | 40/16 X |
| 3,645,485 | 2/1972 | Gold | 211/59.1 X |
| 3,846,925 | 11/1974 | Busse | 40/16.2 |
| 4,072,246 | 2/1978 | Paulin | 211/59.1 X |
| 4,079,838 | 3/1978 | Granum | 248/DIG. 9 |

FOREIGN PATENT DOCUMENTS

| | | | |
|---|---|---|---|
| 2447032 | 4/1976 | Fed. Rep. of Germany | 211/54.1 |
| 2624881 | 5/1977 | Fed. Rep. of Germany | 248/DIG. 9 |

*Primary Examiner*—John F. Pitrelli
*Assistant Examiner*—G. Lee Skillington
*Attorney, Agent, or Firm*—Fulwider, Patton, Rieber, Lee & Utecht

[57] ABSTRACT

A tag and label holder for displaying merchandise is molded as a unitary structure with end sections delineated by narrow, weakened webs. The end sections can be broken away from the central portion of the label holder and discarded to alter the length of the label holder to the size of the price tag or merchandise identification label to be mounted therein.

7 Claims, 8 Drawing Figures

BREAKAWAY TAG LABEL HOLDER

BACKGROUND OF THE INVENTION

1. Field of the Invention

The present invention relates to sales price and merchandise identification label holders in which cards are mounted bearing a written or printed price and/or an optically encoded price or merchandise identification code.

2. Description of the Prior Art

In the past, various tag and label holders have been utilized to display unit or quantity prices and indentification codes of articles offered for sale in retail merchandise establishments. The label holders may be clipped onto the edges of display shelves bearing merchandise, they may be hung by mounting brackets from mounting rails or they may be carried in cantilever fashion at the ends of mounting rods projecting outward from a support. The latter arrangement is frequently used in conjunction with cantilevered merchandise hangers, secured at their bases to associated cantilevered price tag holder mounting bars and fastened to peg boards or other vertical supports. The cantilevered tag holder mounting arrangement is particularly useful where the prices displayed are printed on cards mounted in the holders and appear not only in arabic numerals and alphabet characters, but also in optically encoded form. Indeed, in some instances the label contains only the optically encoded unit or quantity price or an optically encoded stock number or other merchandise indentification. This facilitates the accurate maintenance of inventory since the merchandise stock number and/or price can be recorded with an optical sensor wand that is directed at the optically encoded label and swept thereacross. This eliminates the time consuming process of manually recording stock numbers and their associated inventory counts. When an optical encoding inventory control system is employed, the wand is merely swept across the encoded merchandise identification indicia and a numerical inventory count is entered through a keyboard or other electronic input device. By mounting the labels in cantilever fashion, access to the label holder is facilitated and the time required to take inventory is shortened.

Heretofore merchandise display label holders have typically been provided in a single fixed size. This size may be large enough to accommodate the largest size display labels that are likely to be provided. When the label holders are so large, however, they are inappropriate for use with labels of significantly smaller size. Since price and merchandise identification tags are provided in a variety of lengths, the affixation of a short tag to a long label holder presents both an unsightly appearance and a visual hinderance. Inordinately long label holders impair the visibility of proximately located merchandise and prevent close packing of materials in a display. On the other hand, if the label holders provided are too short for the price or merchandise identification tag, the overhanging ends of the tag are subject to rapid deterioration, since they are invariably bent and soiled as people brush them aside to gain access to the merchandise displayed.

In other types of conventional price and merchandise identification display systems, tags may be monted on a flexible backing which can be cut to length. This requires a separate cutting instrument, however, and in any event is unsuitable when the tags are to be displayed on holders in cantilevered fashion. Rather, the use of flexible holders is appropriate only where the holder is to be directly mounted on a firm backing support, such as the edge of a merchandise display shelf.

SUMMARY OF THE INVENTION

The present invention is a merchandise display label holder which is formed as a rigid, shallow channel, the legs of which entrap a label that displays indicia concerning the merchandise associated therewith. The channel includes a plurality of transverse grooves which define straight, fracturable webs therein. Portions of the channel can thereby be broken away at the webs by flexing the ends of the channel out of the plane of channel orientation. This breaks the channel along the weakened fracture lines defined by the webs. One, two or more sections may be broken off of each end of the channel until the portion of the channel remaining is just long enough to accommodate the size of card or tag to be inserted therein. The invention thereby provides a simple and efficient means for avoiding the unslightliness and the physical impediments presented by inappropriately sized label holders.

The invention may be described with greater clarity and particularly by reference to the accompanying drawings.

DESCRIPTION OF THE EMBODIMENT

Figure 1:
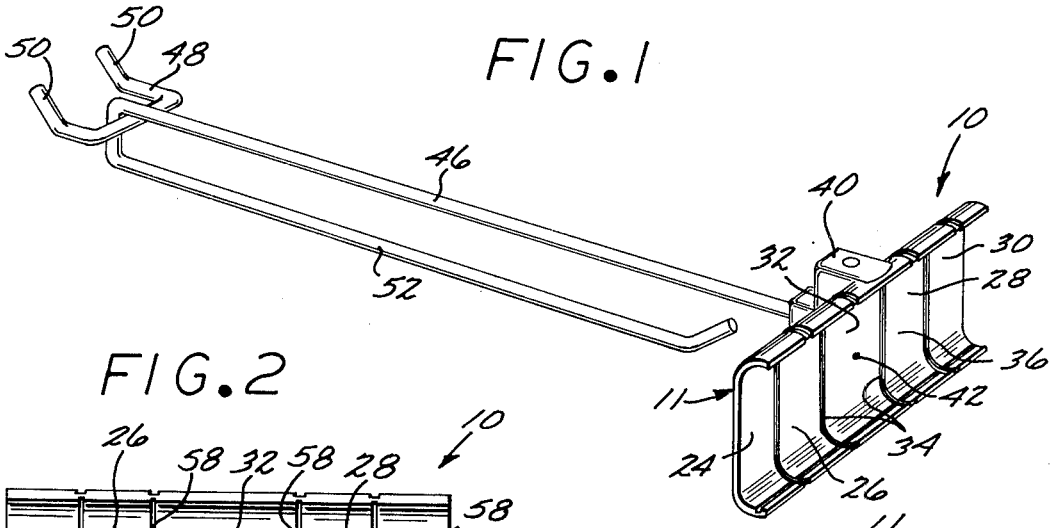
FIG. 1 is a prespective view of a label holder according to the invention mounted in cantilever fashion.
Figure 2:
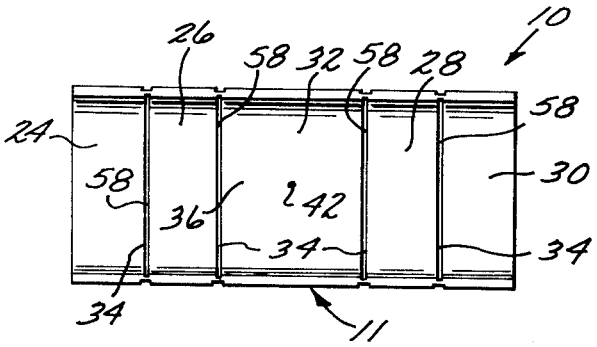
FIG. 2 is a front elevational view of the label mount of FIG. 1.
Figure 6:
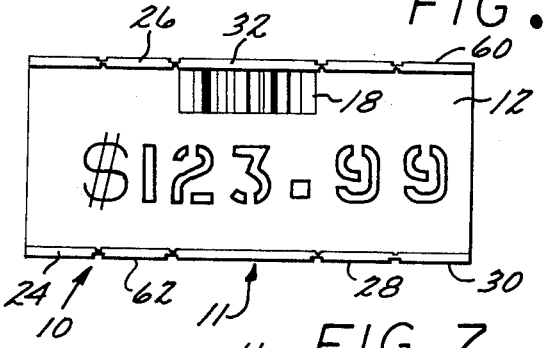
FIG. 6 is a front elevational view showing the label holder with its entire length utilized to support a long tag.
Figure 7:
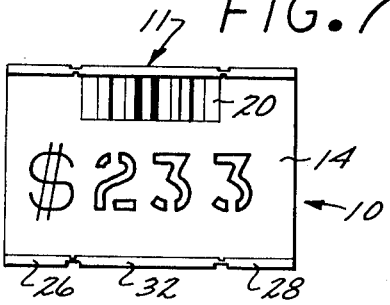
FIG. 7 is a front view of the label holder with sections broken away and used to support a medium length tag.
Figure 8:
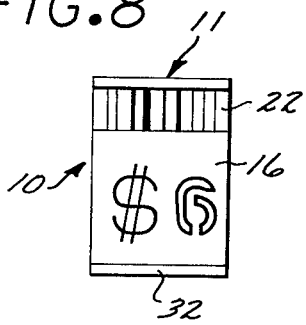
FIG. 8 is a front view of the label holder with additional sections broken away and used to support a short tag.

FIG. 1 illustrates label holder 10 for holding a flat card 12, 14 or 16, as illustrated in FIGS. 3 and 6–8. The cards 12, 14 and 16 bear a price for viewing, or additionally or alternatively on optically encoded merchandise identication code, indicated at 18, 20 and 22 respectively in FIGS. 6–8. As depicted in FIG. 2, the label holder 10 is formed by a rigid, shallow channel shaped merchandise display mounting member 11 that is of unitary construction with end sections 24, 26, 28 and 30 bounding a center section 32 and delineated by weakened webs indicated at 34. As depicted in FIG. 4 in dashed lines, the end sections 24, 26, 28 and 30 can be broken away and discarded to conform the length of the mounting member 11 to the length of the card 12, 14 or 16 to be mounted therein, as depicted in FIGS. 6–8.

Figure 3:
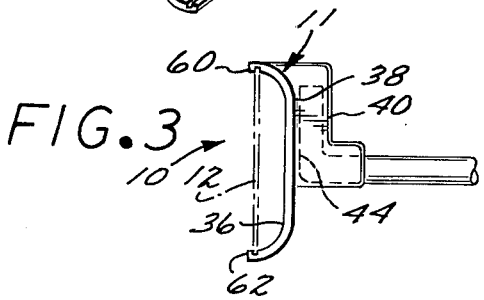
FIG. 3 is a side elevational view of the label mount of FIG. 1.
Figure 4:
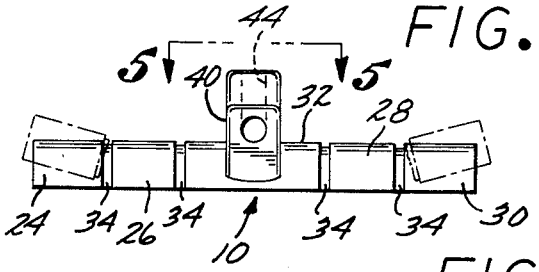
FIG. 4 is a top elevational view illustrating the alteration of label holder size.

The mounting member 11 of the label holder 10 has a front concave surface 36 and a rear convex surface 38, illustrated in FIGS. 1–3. A mounting socket 40 extends rearward from the rear convex surface 38 at the longitudinal center 42 (FIGS. 1–3) of the label holder 10. The socket 40 is a boot-shaped housing with an opening extending horizontally rearwardly and turned upwardly to form an L-shaped cavity therein, depicted at 44.

The label holder 10 also includes an elongated cylindrical stainless steel mounting rod 46 extending in cantilever fashion outwardly from a U-shaped base bracket 48 as depicted in FIG. 1. The upturned ends 50 of the U-shaped base bracket 48 are inserted into corresponding holes in a peg board for use in securing the label holder 10 in position to display a label 12, 14 or 16. In this fashion, the label holder 10 is held at a distance from a peg board by the cantilever mounting provided by mounting rod 46. As indicated in FIG. 3, the extremity of the cantilever mounting rod 46 is turned upward, and is insertable into the mounting socket 40 of the label holder 10. As depicted in FIG. 1, the cantilever rod 46 is bent around the base bracket 48, to which it is welded, and forms a wire merchandise hanging rod 52 that extends from the cantilever rod 46 from a location remote from the mounting socket 40 of the label holder 10. The hanging rod 52 extends parallel to and beneath the cantilever rod 46. Articles of merchandise may thereby be suspended from the hanger rod 52. Such articles may be impaled by the hanging rod 52 by apertures formed directly therein, or by apertures through a merchandise container. Balloons, toys, and other small articles that are normally packed and sold in plastic bags may thereby be suspended from the hanger rod 52.

Figure 5:
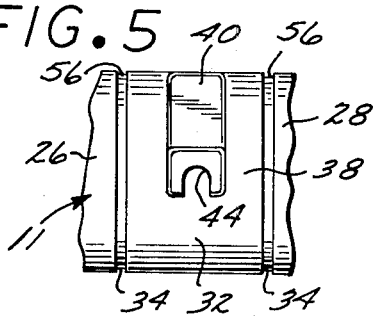
FIG. 5 is an enlarged elevational view of the central rear surface of the label holder mount.

As can be seen in FIGS. 2, 4 and 5, the channel shaped mounting member 11 includes a pair of end sections on either side of its longitudinal center 42. That is, end sections 28 and 30 are located to the right of the center 42, while end sections 24 and 26 are located to the left, as viewed from the front in FIG. 2. Grooves 56 are defined in the channel 11 in the convex rear surface 38 thereof and are visible in FIG. 5. As illustrated in FIG. 2, grooves 58 are defined in the front concave surface 36 of the channel 11. By comparison, it can be seen that the grooves 56 in the rear convex side 38 are greater in breadth than the grooves 58 in the front concave side 36. The grooves 56 and 58 are located directly opposite each other on the opposing sides of the channel 11 to define the fracturable webs 34.

Preferably, the mounting channel 11 of the label holder 10 is an integrally formed molded plastic structure of ABS, polycarbonate or some other rigid, relatively brittle plastic. The webs 34 are located between the levels of the inner and outer surfaces 36 and 38 of the channel 11.

Preferably also, the original length of the channel 11 is about 3 inches, but it may be reduced to a length of only 1 inch by breaking away all of the end sections 24, 26, 28 and 30. Each of these end sections is approximately $\frac{1}{4}$ inch in length. By breaking away one of the end sections at a time, the holder 10 can be altered to fit tags of 3 inches, $2\frac{3}{4}$ inches, $2\frac{1}{2}$ inches, $2\frac{1}{4}$ inches, 2 inches, $1\frac{3}{4}$ inches, $1\frac{1}{2}$ inches, $1\frac{3}{4}$ inches and 1 inch, as desired.

FIG. 6 illustrates a label 12 with a price indication and with an optically encoded product identification at 18. The label 12 is approximately 3 inches long and is received within the channel 11 without any significant longitudinal extension of the channel 11 beyond the length of the label 12. The label 12 is held in position in the channel 11 by slight overhanging lips 60 and 62, extending from the extremities of the legs of the channel 11, as depicted in FIG. 3.

As illustrated in FIG. 4, the channel 11 can be shortened in length to accomodate the shorter tag 14, depicted in FIG. 7. This is achieved by breaking away the end sections 24 and 30 from the ajoining sections 26 and 28 respectively. This is accomplished by grasping the end sections 24 and 30 while immobilizing the adjoining sections 26 and 28. The end sections 24 and 30 may then be forced rearwardly, thereby fracturing the weakened webbing sections 34 adjacent thereto. Once removed, the end sections 24 and 30 are discarded and the channel 11 is shortened in length to accommodate the tag 14, as depicted in FIG. 7.

To shorten the channel 11 still further, the remaining end sections 26 and 28 may likewise be broken away from the center section 32 to accommodate a shorter tag 16, depicted in FIG. 8. In the embodiment of FIG. 8, only the center section 32 of the mounting channel 11 remains held upon the mounting socket 40 in cantilever fashion as hereinbefore described.

It should be understood that numerous variations and modifications of the invention are possible. There is a wide variety of rigid, brittle structural materials from which to chose in the construction of the display label holder. Also, various alternative web configurations and dimensions to those depicted in the drawings are available. Accordingly, the invention should not be construed as limited to the specific embodiment depicted herein, but rather is defined in the claims appended hereto.

I claim:

1. A label holder for a merchandise display comprising an integrally formed rigid, shallow, molded plastic channel having a concave front surface and a convex back surface with at least one pair of parallel grooves, transverse to said channel, defined completely across said channel in at least one of said front and back surfaces to form fracturable webs on both sides of and the grooves in each pair are equidistant from the longitudinal center of said channel.

2. A label holder according to claim 1 further characterized in that grooves are defined in both said front and back surface of said channel, and said grooves in said back surface of said channel are wider than said grooves in said front surface of said channel.

3. A label holder according to claim 1 further characterized in that said grooves in said convex side of said channel are greater in breath than said grooves in said concave side of said channel.

4. A label holder according to claim 1 further characterized in that said grooves define two breakaway sections on each side of the longitudinal center of said channel.

5. A merchandise display label holder for holding a laminar card bearing merchandise information comprising, an integrally molded plastic mounting member having a shallow, concave front surface for holding a card as aforesaid and having at least one pair of parallel grooves transverse to the length of said member, defined in at least one of said front surface and a convex back surface of said mounting member completely thereacross, and the grooves in each pair are equidistant from the longitudinal center of said mounting member, whereby said grooves define a plurality of weakened webs extending transversely across the entire breadth of said mounting member to delineate a center section and equal end sections at opposite ends of said mounting member, which end sections can be broken away and discarded to conform the length of said of mounting member to the length of said card.

6. A merchandise display label holder according to claim 5 further characterized in that said mounting member has a reverse side equipped with a mounting socket at the longitudinal center thereof for cantilevered attachment to a support.

7. A merchandise display label holder according to claim 6 further comprising a cantilevered rod having one end connected to said support and an opposite end engaged in said mounting socket for carrying said mounting member from said support and further comprising a merchandise hanger extending from said cantilever rod from a location remote from said mounting socket of said mounting member, and extending parallel to said cantilever rod therebeneath.

* * * * *

UNITED STATES PATENT OFFICE

CERTIFICATE OF CORRECTION

Patent No. 4,246,710 Dated January 27, 1981

Inventor(s) TERENCE W. MIXER

It is certified that error appears in the above-identified patent and that said Letters Patent are hereby corrected as shown below:

At column 1, line 65 "monted" should be corrected to -- mounted --.

At column 2, line 54, "on" should be corrected -- an --.

At column 4, line 39, the words "on both sides of" should be deleted.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*